US007832250B2

(12) United States Patent
Knewtson

(10) Patent No.: US 7,832,250 B2
(45) Date of Patent: Nov. 16, 2010

(54) METHOD AND APPARATUS FOR AUTOMATING PRODUCTION OF SINUOUS SPRINGS

(75) Inventor: Kelly M. Knewtson, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 389 days.

(21) Appl. No.: 12/105,387

(22) Filed: Apr. 18, 2008

(65) Prior Publication Data

US 2009/0260411 A1 Oct. 22, 2009

(51) Int. Cl.
*B21D 31/00* (2006.01)
*B21F 11/00* (2006.01)

(52) U.S. Cl. ..... 72/387; 140/71 R; 140/102; 72/129; 72/172; 72/385

(58) Field of Classification Search ..... 72/129, 72/172, 381, 383, 385, 386, 387, 388; 140/71 R, 140/102, 104, 105
See application file for complete search history.

(56) References Cited

U.S. PATENT DOCUMENTS

| | | | | |
|---|---|---|---|---|
| 2,582,576 | A | 1/1952 | Zweyer | |
| 2,700,409 | A * | 1/1955 | Weiss | 72/172 |
| 2,830,646 | A | 4/1958 | Norman | |
| 3,180,371 | A * | 4/1965 | Hughes | 140/102 |
| 3,191,636 | A * | 6/1965 | Hampson | 140/71 R |
| 3,382,896 | A * | 5/1968 | Hopkes, Jr. | 140/71 R |
| 3,869,900 | A | 3/1975 | Norman | |
| 3,874,425 | A | 4/1975 | Guenther | |
| 4,062,528 | A | 12/1977 | Olivero | |
| 4,121,628 | A | 10/1978 | Waligore et al. | |
| 4,270,582 | A * | 6/1981 | Norman | 140/71 R |
| 4,291,732 | A | 9/1981 | Artzer | |
| 4,294,102 | A | 10/1981 | Luckert et al. | |
| 4,526,025 | A * | 7/1985 | Ritter et al. | 72/388 |
| 4,860,999 | A | 8/1989 | Ritter et al. | |
| 4,947,670 | A | 8/1990 | Wu | |
| 5,150,600 | A | 9/1992 | Wentzek et al. | |
| 5,251,881 | A | 10/1993 | Reiniche | |
| 5,483,459 | A | 1/1996 | Tamura | |
| 5,887,471 | A | 3/1999 | Itaya | |
| 6,023,955 | A | 2/2000 | Grondahl | |
| 6,196,100 | B1 | 3/2001 | David et al. | |
| 6,263,573 | B1 | 7/2001 | Bullard | |
| 6,264,183 | B1 | 7/2001 | Meier et al. | |
| 6,705,355 | B1 | 3/2004 | Wiesenfeld | |
| 6,923,034 | B2 | 8/2005 | Matsuoka | |
| 2009/0260411 | A1 * | 10/2009 | Knewtson | 72/387 |

* cited by examiner

*Primary Examiner*—David B Jones
(74) *Attorney, Agent, or Firm*—Wood, Herron & Evans, LLP

(57) ABSTRACT

A method and apparatus is disclosed for manufacturing sinuous springs wherein each spring comprises a discrete length of sinuous spring wire having parallel straight bar segments interconnected at their opposite ends by oppositely directed curved connecting segments. This apparatus is operable to adjust the length of the sinuous spring wires exiting the machine without turning off or stopping the machine. An operator need only rotate a handle outside a housing of the machine to increase or decrease the length of the sinuous spring wires exiting the machine.

15 Claims, 9 Drawing Sheets

METHOD AND APPARATUS FOR AUTOMATING PRODUCTION OF SINUOUS SPRINGS

FIELD OF THE INVENTION

This invention relates generally to sinuous wire springs and, more particularly, to a method and apparatus for producing sinuous wire springs.

BACKGROUND OF THE INVENTION

Many furniture products, including such products as chairs, sofas and automobile seats utilize sinuous wire spring elements as to create resilient surfaces, such as seats and backrests, in an item of furniture. Such resilient spring elements are disclosed, for example, in U.S. Pat. No. 6,263,573. Each resilient sinuous spring element has a plurality of straight bar portions joined by a plurality of connecting or curved or radiused portions. Generally, these sinuous spring elements are manufactured on a machine which produces a quantity of identical sinuous springs, each sinuous spring having the same number of straight bar portions and the same radius in its curved portions. Therefore, each resilient sinuous spring element has the same length. The machine had to be stopped and adjusted to manufacture sinuous spring elements of different lengths. Prior to the present invention, in order to adjust the length of the resultant sinuous spring element, one had to stop the operation of the machine and make the necessary adjustments to the machine. Upon restarting the machine, a different size resilient sinuous spring element would be produced. Each time a different length of resilient sinuous spring element was desired, the operator had to stop the machine, adjust the machine and then restart the machine. Each time the operator stopped the machine, the machine was not producing resilient sinuous spring elements. This reduced the output of the machine and required skilled operators to properly adjust the machine.

Therefore, it is one objective to the present invention to provide a machine for manufacturing sinuous spring elements which does not have to be stopped or turned off in order to change the length of the resilient sinuous spring element produced by the machine.

It is another objective of the present invention to provide an apparatus for use on a machine used to make sinuous spring elements which enables the machine to produce sinuous spring elements of different lengths without turning off the machine.

It is another objective of the present invention to maintain a desired length of sinuous spring despite changes in machine speed and/or changes to the wire being introduced into the machine.

SUMMARY OF THE INVENTION

The apparatus or machine of this invention which accomplishes these objectives and one aspect of the invention of this application comprises a machine for manufacturing a plurality of sinuous springs from a supply of wire. The machine comprises a forming apparatus for forming a continuous length of sinuous spring wire having parallel bar segments interconnected at their opposite ends by oppositely directed connecting segments. The forming apparatus includes a shuttle, an oscillator and an overbend tool adjustable during operation of the machine via an adjustment apparatus.

The adjustment apparatus functions to adjust or change the position of the overbend tool via a rotation of a rotatable handle, the handle being outside the housing of the forming apparatus. The adjustment apparatus comprises an adjustment rod having a first end and a second end. The handle is connected to the first end of the adjustment rod for adjusting the length of the adjustment rod. The adjustment apparatus further comprises an end piece connected to the second end of the adjustment rod. The end piece is operatively coupled to an adjustment link at one end of the adjustment link; the opposite end of the adjustment link being operatively coupled to a crank lever which oscillates about an axis defined by a bearing pin. The crank lever is driven by a crank disc via a push rod assembly connected at one end to the crank disc and at the other end to one end of the crank lever. The opposite end of the crank lever is operatively coupled to a slide block which reciprocates in a linear manner.

The slide block has a pair of cam blocks and a pair of guide pins attached thereto. The cam blocks have slots therein for guiding an overbend tool assembly, the guide pins being retained in the overbend tool assembly for further guiding said overbend tool assembly. The adjustment apparatus further comprises a cover with a slot therein thorough which a portion of the overbend tool assembly passes to provide a stop for the wire. The adjustment apparatus further comprises a guide cover and a pair of clamp assemblies for securing the guide cover in place. During operation, the sinuous wire passes under the guide cover and over the cover. The machine comprises lubrication means to keep the machine components lubricated to help the continuous length of sinuous spring wire move through the forming apparatus smoothly and without binding until it passes to an accumulator.

The machine further comprises an accumulator downstream of the forming apparatus and a punch press for cutting the continuous length of sinuous wire into sinuous springs of discrete lengths. The punch press is downstream of the accumulator.

According to another aspect of this invention, a method of manufacturing sinuous springs is provided. Each sinuous spring comprises a discrete strip of sinuous spring wire having parallel bar segments interconnected at their opposite ends by oppositely directed connecting segments. The method comprises first introducing a continuous supply of wire into a machine. The method further comprises forming a continuous length of sinuous spring wire having parallel bar segments interconnected at their opposite ends by oppositely directed connecting segments using a forming apparatus. The forming apparatus includes a shuttle, an oscillator and an overbend tool adjustable during operation of the machine via an adjustment apparatus to change the position of the parallel bar segments relative to the connecting segments in the resulting continuous length of sinuous spring wire which exits the forming apparatus and passes through the accumulator and onto the punch press for cutting the continuous strip of sinuous wire into strips of discrete lengths.

Another way to describe this method is as follows: a method of manufacturing sinuous springs, each sinuous spring comprising a discrete strip of sinuous spring wire having parallel bar segments interconnected at their opposite ends by oppositely directed connecting segments. The method comprises first providing a machine for manufacturing sinuous springs of the same length and then adding an adjustment apparatus to the machine so an operator may adjust the length of the sinuous springs by turning a handle. The adjustment apparatus changes the position of an overbend tool adjustable during operation of the machine to change the position of the parallel bar segments relative to the connecting segments. Using this method to retrofit an existing machine enables an operator to change the length of the sinuous springs exiting the punch press without stopping or interrupting the operation of the machine. Allowing the machine to operate continuously improves the productivity and efficiency of the machine while reducing the need for a skilled operator to adjust the machine.

These and other objects and advantages of this invention will become more readily apparent from the following description of the drawings.

DESCRIPTION OF THE DRAWINGS

FIG. 10AA is a side elevational view of a portion of the adjustment apparatus showing the position of the overbend tool while the oscillator is in the position shown in FIG. 10A;

FIG. 10BB is a side elevational view of a portion of the adjustment apparatus showing the position of the overbend tool while the oscillator is in the position shown in FIG. 10B;

FIG. 10CC is a side elevational view of a portion of the adjustment apparatus showing the position of the overbend tool while the oscillator is in the position shown in FIG. 10C;

FIG. 10DD is a side elevational view of a portion of the adjustment apparatus showing the position of the overbend tool while the oscillator is in the position shown in FIG. 10D;

FIG. 10EE is a side elevational view of a portion of the adjustment apparatus showing the position of the overbend tool while the oscillator is in the position shown in FIG. 10E;

FIG. 10FF is a side elevational view of a portion of the adjustment apparatus showing the position of the overbend tool while the oscillator is in the position shown in FIG. 10F.

DETAILED DESCRIPTION OF THE INVENTION

Figure 1:
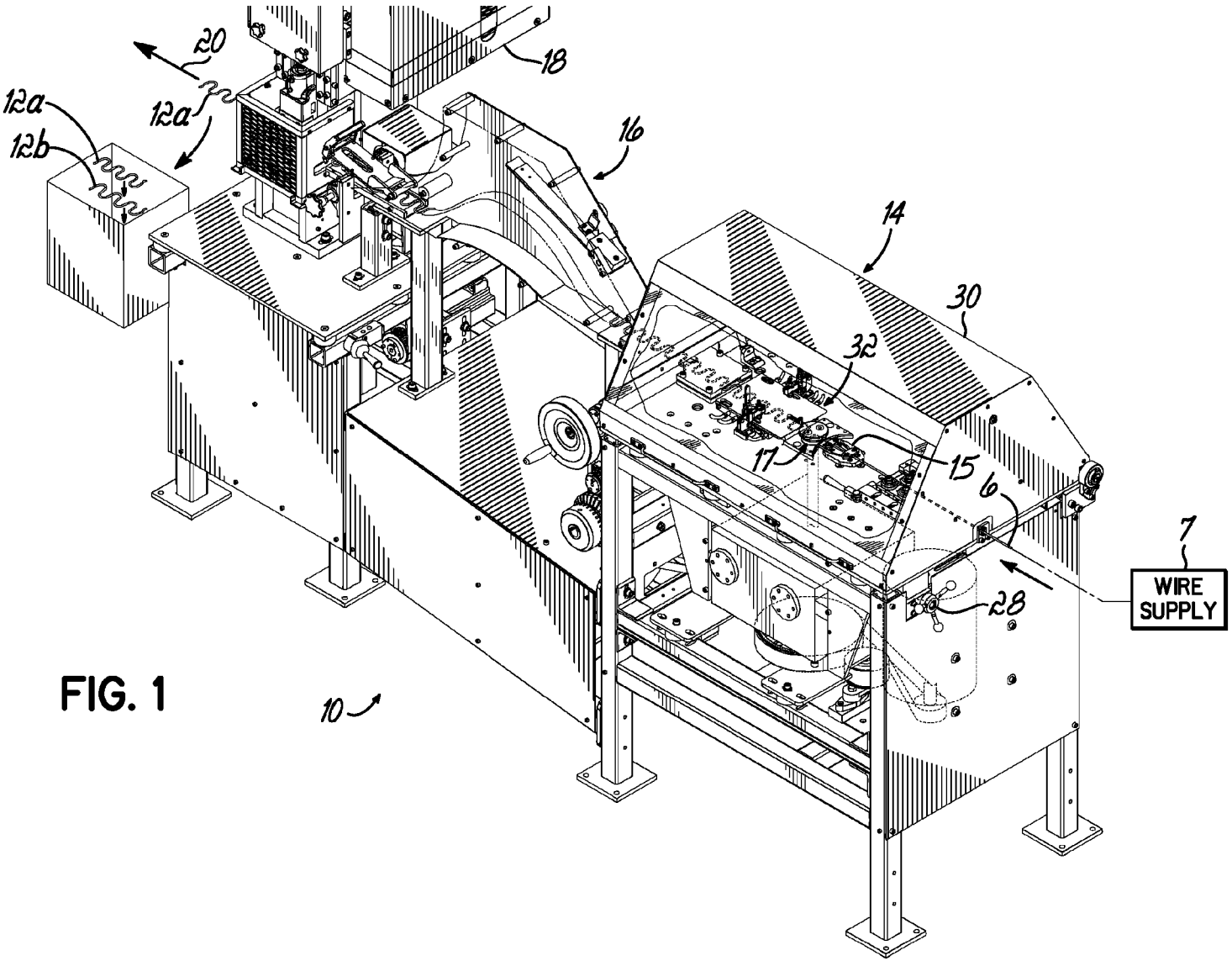
FIG. 1 is a perspective view of a machine for practicing the inventive method of this invention.

Referring to the figures, and particularly, to FIG. 1, there is illustrated a machine 10 for manufacturing a plurality of sinuous springs 12. The machine 10 has three principal components: a forming apparatus 14, an accumulator 16 downstream of the forming apparatus 14 and a punch press 18 downstream of the accumulator 16 (the flow of wire is generally indicated by the arrow 20).

The forming apparatus 14 enables sinuous springs 12*a*, 12*b* to exit the downstream end of the machine 10 of different lengths without turning off or shutting down the machine 10 to make manual adjustments to it. Instead, an adjustment apparatus 32, shown in an assembled condition in FIG. 2, and disassembled in FIG. 5, has been incorporated into the machine 10. More particularly, the adjustment apparatus 32 has been incorporated into the forming apparatus 14 of the machine 10 to enable sinuous springs of different lengths to be produced on the machine 10 without stopping the machine 10. As best shown in FIGS. 10A-10FF, forming apparatus 14 includes a shuttle 15 and an oscillator 17 downstream of the shuttle 15. The oscillator rotates clockwise and counterclockwise a full 360 degrees and includes two pins 19*a* and 19*b*, pin 19*a* being illustrated with a plus symbol on it and pin 19*b* being illustrated with a minus symbol on it for purposes of clarification. See FIGS. 10A-10FF.

Figure 3:
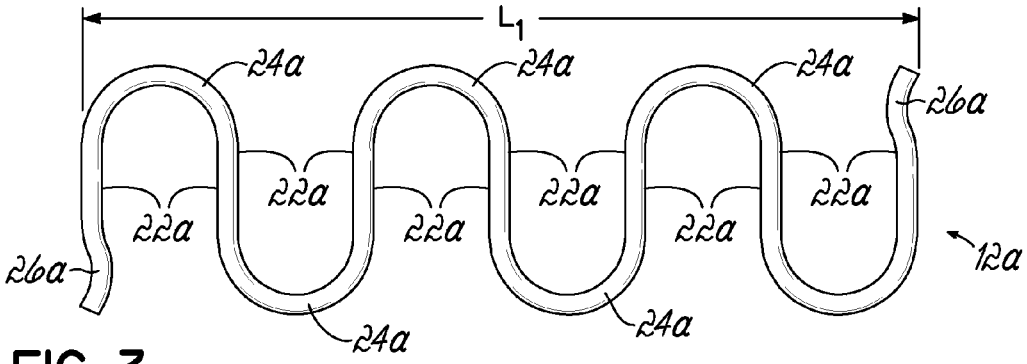
FIG. 3 is a top plan view of a sinuous spring of a first length produced on the machine of FIG. 1.
Figure 4:
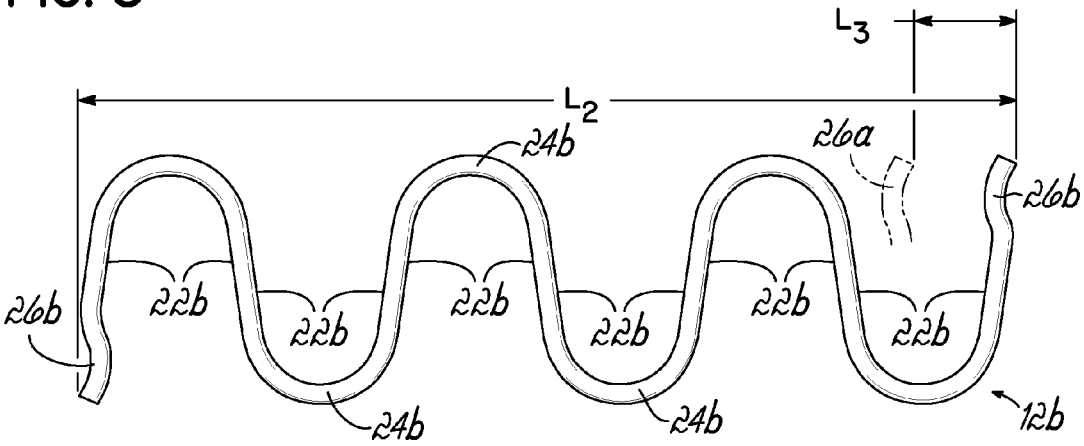
FIG. 4 is a top plan view of a sinuous spring of a second length greater than the first length produced on the machine of FIG. 1.

As shown in FIGS. 3 and 4, the machine 10 of the present invention produces sinuous springs 12*a* and 12*b* along with sinuous springs of different lengths. FIG. 3 shows a sinuous spring 12*a* having seven straight parallel bar segments 22*a* joined at their ends by oppositely directed curved or arcuate connecting segments 24*a*. The sinuous spring 12*a* has at each end a tail portion 26*a*. The sinuous spring 12*a* has a length L1 which may be increased by a length L3 (the difference between L2 and L1) simply by rotating a handle 28 located outside a housing 30 of the forming apparatus 14 from one extreme to another. FIG. 1 shows the housing 30 partially broken away so that one may see the adjustment apparatus 32 of the present invention.

FIG. 4 shows a sinuous spring 12*b* which may be produced on machine 10 without having to stop or interrupt operation of the machine. Sinuous spring 12*b*, like sinuous spring 12*a*, has seven straight parallel bar segments 22*b* joined at their ends by oppositely directed curved or arcuate connecting segments 24*b*. The sinuous spring 12*b* has at each end a tail portion 26*b*. The sinuous spring 12*b* has a length L2 greater than the length L1 of sinuous spring 12*a* by a distance L3. The machine 10 may produce sinuous springs having any desired number of straight bar segments and corresponding connecting segments.

A servo drive (not shown) drives a feed wheel (not shown) and counts the number of straight parallel bar segments prior to activation of the punch press 18. The accumulator allows wire to continue flowing through the forming apparatus 14 while the flow of sinuous wire is momentarily stopped to allow the punch press 18 to sever the sinuous wire at the desired location. The servo drive momentarily stops the flow of sinuous wire to allow the punch press to activate.

Figure 2:
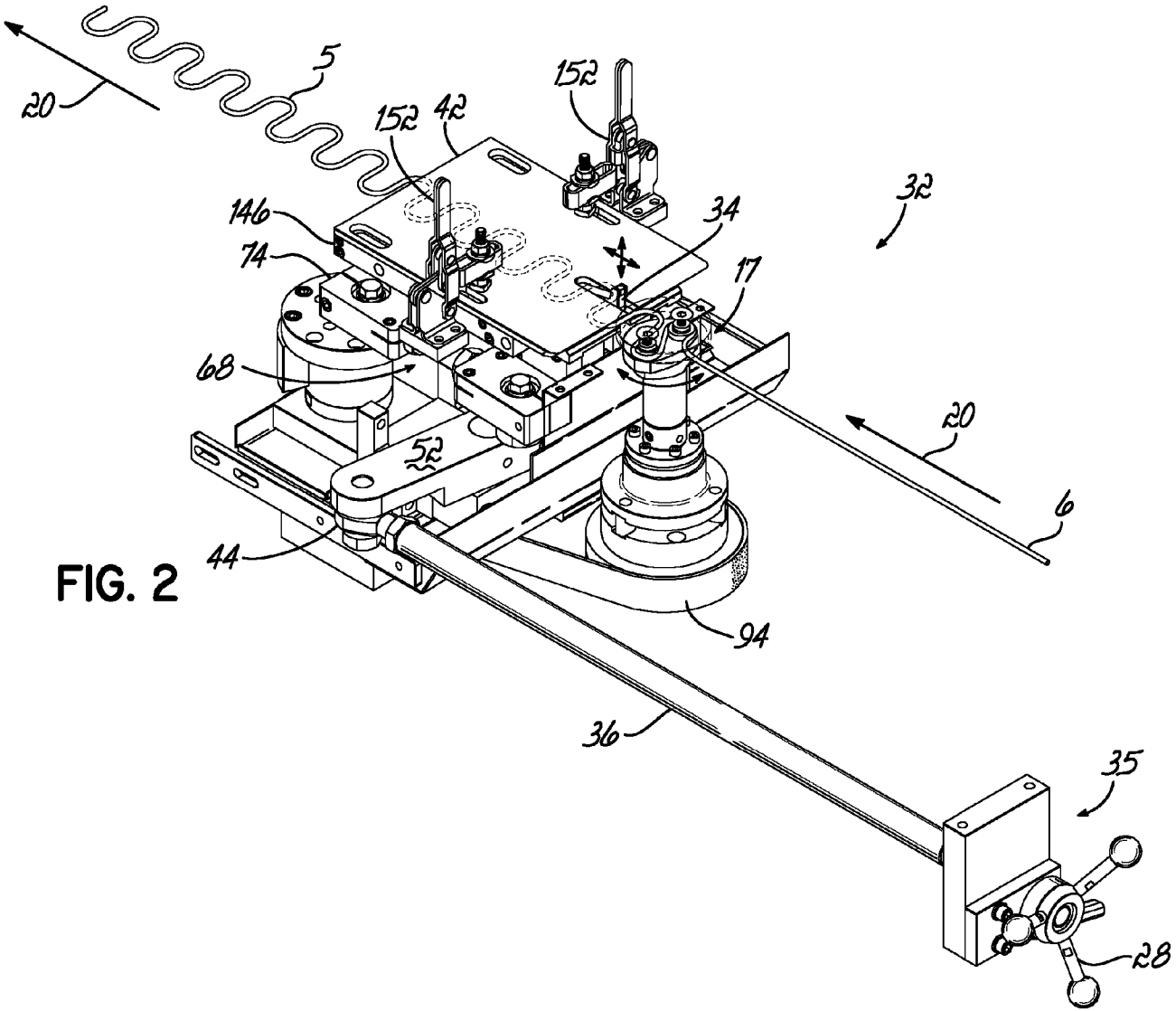
FIG. 2 is an enlarged perspective view of the adjustment apparatus comprising part of the machine of FIG. 1.

FIG. 2 illustrates the adjustment apparatus 32 for use in the forming apparatus 14. The adjustment apparatus 32 is used to change the position of the overbend tool 34 as a front portion or stop 142 extends upwardly through a slot 40 in a cover plate 39 and through a slot 2 in a guide cover 42.

Figure 5:
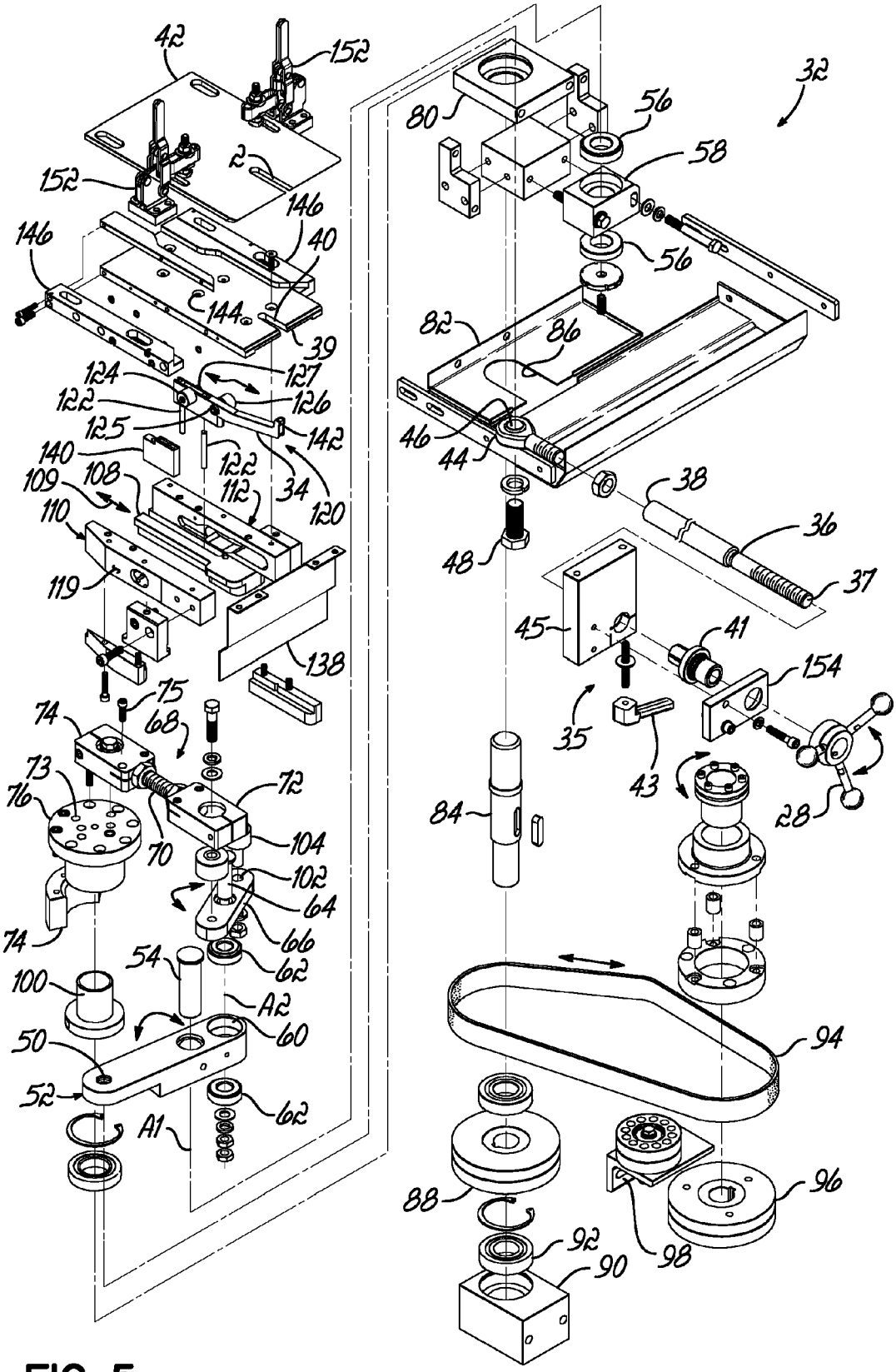
FIG. 5 is a disassembled view of the adjustment apparatus of FIG. 2.

FIG. 5 illustrates a disassembled view of the adjustment apparatus 32. The adjustment apparatus 32 comprises an adjustment rod 36 having a first end 37 to which a three-pronged handle 28 is attached outside of the housing 30. The handle 28 may be locked in a fixed position by a locking mechanism 35 comprising a cover plate 154, a hub 41, a locking handle 43 and a lock block 45.

An end piece 44 is attached to the opposite end 38 of the adjustment rod 36, the end piece 44 having a centrally located hole 46 therethrough. A threaded fastener 48 ends through the hole 46 in the end piece 44 and is threadably engaged inside a hole 50 at one end of an adjustment link 52. The adjustment link 52 acts as a teeter totter and oscillates or pivots about a vertical axis A1 defined by a pivot pin 54 which extends through bearings 56 located inside a pivot mount 58. The other end of the adjustment link 52 has recesses 60 into which fit bearings 62. A bearing pin 64 extends through bearings 62 and defines a vertical axis A2 which is located at the center of a crank lever 66. Thus, one end of the adjustment link 52 is joined by bearing pin 64 to the center of the crank lever 66, which acts as a second teeter totter device and pivots about the second axis A2 defined by bearing pin 64. One end of the crank lever 66 is secured to a push rod assembly 68 comprising a push rod 70 and two opposed push rod ends 72, 74. Push rod end 74 is secured to a crank disk 76 with fasteners 75 and may be manually adjusted, if desired. The crank disk 76 has a plurality of openings 73 into which fasteners 75 fit.

By changing the position of the push rod assembly 68 relative to the crank disk 76, one may adjust the extreme positions of the overbend tool 34 and more specifically, the position of the front stop 142 of the overbend tool 34. The crank disk 76 has a counterweight 78 attached thereto and is mounted in an upper bearing mount 80 located above an oil pan 82 and driven by a drive shaft 84 which passes through an opening 86 in the oil pan 82. The drive shaft 84 is operably coupled to a timing pulley 88 using a keyed locking mechanism. A bearing mount 90 is below the timing pulley 86 and houses bearing 92. A timing belt 94 passes around the timing pulley 86 and around a drive pulley 96. An idler assembly 98 is located inside the timing belt 94. Rotation of the drive pulley 96 rotates the timing belt 94 which rotates the drive shaft 84 driven by the timing pulley 88. Rotation of the drive shaft 84 rotates the crank disc 76 inside which resides bushing 100. Rotation of the crank disk 76 moves the push rod assembly 68. More specifically, push rod end 74 is secured to the crank disk 76 while push rod end 72 is secured to one end of the crank lever 66.

Figure 7B:
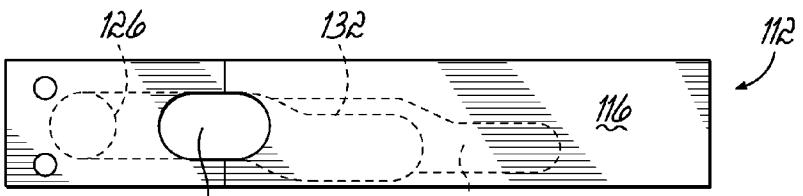
FIG. 7B is a side elevational view of an outside surface of the rear cam block of FIG. 5.
Figure 7A:
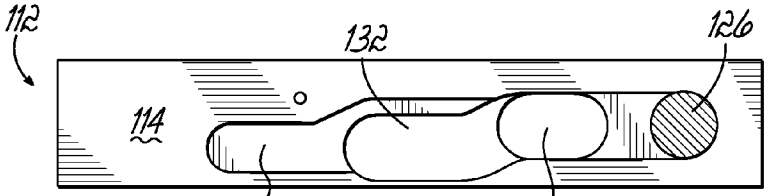
FIG. 7A is a side elevational view of an inside surface of the rear cam block of FIG. 5.
Figure 8B:
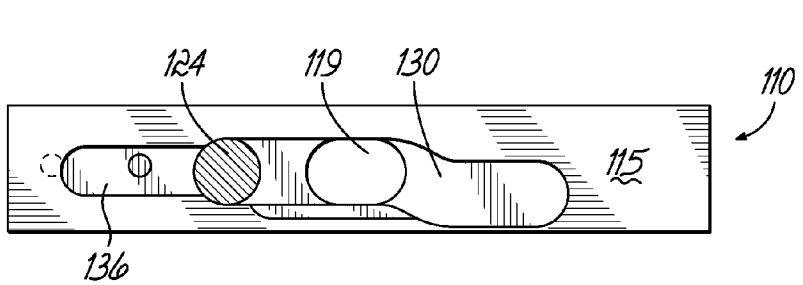
FIG. 8B is a side elevational view of an inside surface of the front cam block of FIG. 5.
Figure 8A:
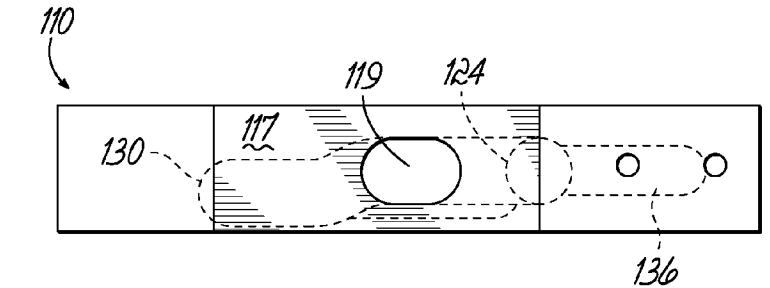
FIG. 8A is a side elevational view of an outside surface of the front cam block of FIG. 5.

The opposite end of the crank lever 66 has an opening 102 therein in which there is secured a cam follower 104. The cam follower 104 rides in a guide 106 in the underside of a slide block 108 which moves in a linear fashion as indicated by arrow 109. Front and rear cam blocks 110, 112 are mounted to the slide block 108 as shown in FIG. 5. FIGS. 7A and 7B show inner and outer surfaces 114, 116 respectively, of the rear cam block 112 along with an opening 118 through the rear cam block 112. FIGS. 8A and 8B show inner and outer surfaces 115, 117 respectively, of the front cam block 110 along with an opening 119 through the front cam block 110.

Figure 9B:
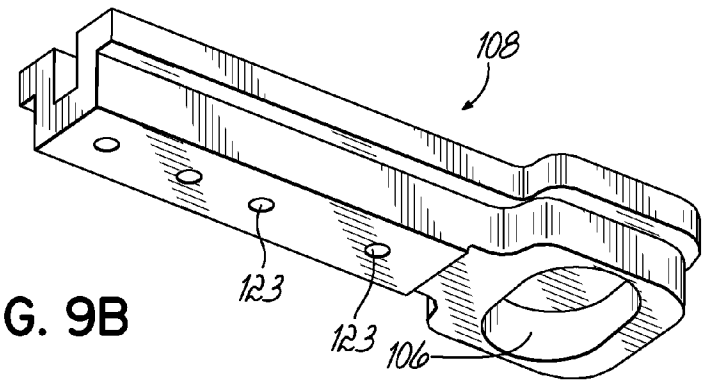
FIG. 9B is a bottom perspective view of the slide block of FIG. 5.
Figure 9A:
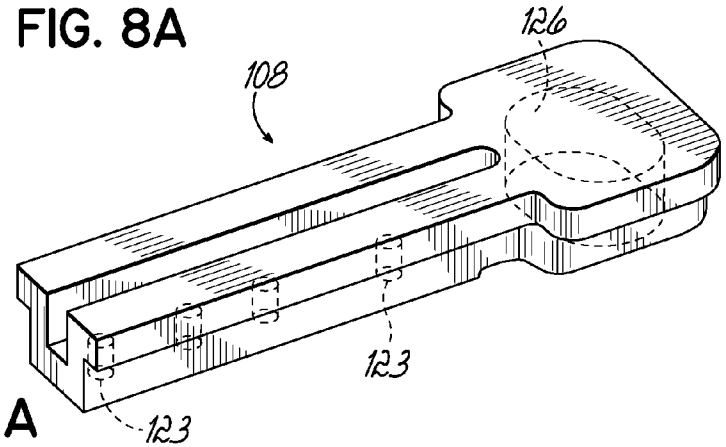
FIG. 9A is a top perspective view of the slide block of FIG. 5.

An overbend tool assembly 120 comprising an overbend tool 34, a front cam pin 124 secured to overbend tool 34 with a fastener 125 and a rear cam pin 126 secured to overbend tool 34 with a fastener 127 moves in and out and up and down in a manner shown in FIGS. 10A-10FF. The front cam pin 124 moves in a groove 130 extending inwardly from the inside surface 117 of the front cam block 110. The rear cam pin 126 moves in a groove 132 extending inwardly from the inside surface 114 of the rear cam block 112. Another groove 134 is located along the inside surface 114 of the rear cam block 112 to allow the fastener 127 to travel with the overbend tool 34. Similarly, another groove 136 is located along the inside surface 115 of the front cam block 110 to allow the fastener 125 to travel with the overbend tool 34. The overbend tool has a pair of pins 122 extending downwardly from the overbend tool 34. These pins 122 fit into two of the holes 123 extending upwardly from a lower surface of the slide block 108, as shown in FIGS. 9A and 9B.

Figure 6:
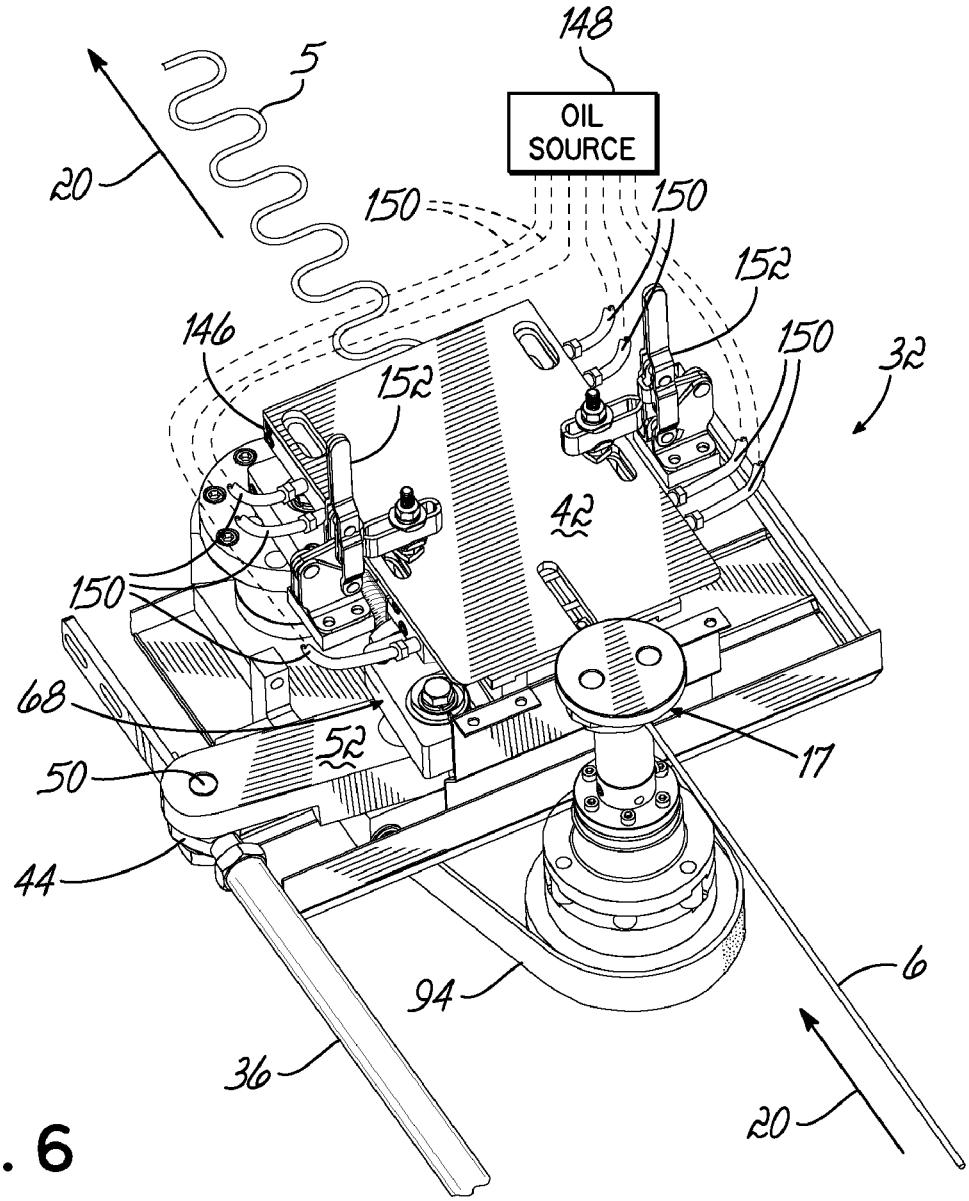
FIG. 6 is a diagrammatic perspective view of the adjustment apparatus of FIG. 2.

Referring to FIG. 5, a debris guard 138 is located at the front of the slide block 108 and a push block 140 is secured to the rear of the slide block 108. The overbend tool 34 has a front stop 142 against which the wire abuts when the machine is operating. The adjustment apparatus 32 further comprises a cover plate 39 having a slot 40 therein. The cover plate 39 is located above the overbend tool 34, the stop 142 of the overbend tool 34 extending through the slot 40 in the cover plate 39. The top of the cover plate 39 is lubricated via fluid flowing through holes 144 in the cover plate 39. A pair of oil rail inserts 146 are secured to the cover plate 39. As shown in FIG. 6, oil flows from an oil source 148, through hoses or lines 150 and through the oil rail inserts 146 to lubricate the upper surface of cover plate 39.

As shown in FIG. 2, the continuous length of sinuous wire 5 extends over the top of the cover plate 39 and underneath a guide cover 42 which is clamped in place using a pair of clamp assemblies 150. The continuous length of sinuous wire 5 passes below the guide cover 42 and above the cover plate 39 as it is flowing downstream into the accumulator 16 and then on to the punch press 18.

Figure 10A:
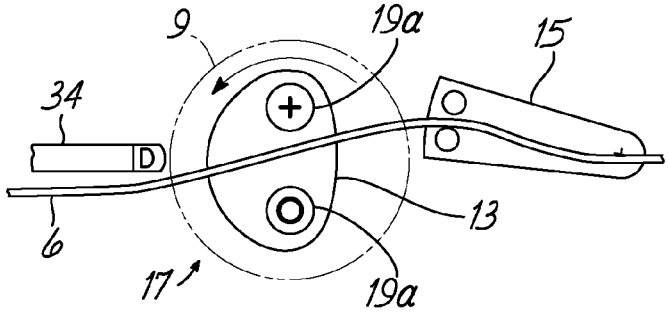
FIG. 10A is a top view of the oscillator moving in a counterclockwise direction to begin forming a continuous length of sinuous wire.
Figure 10A:
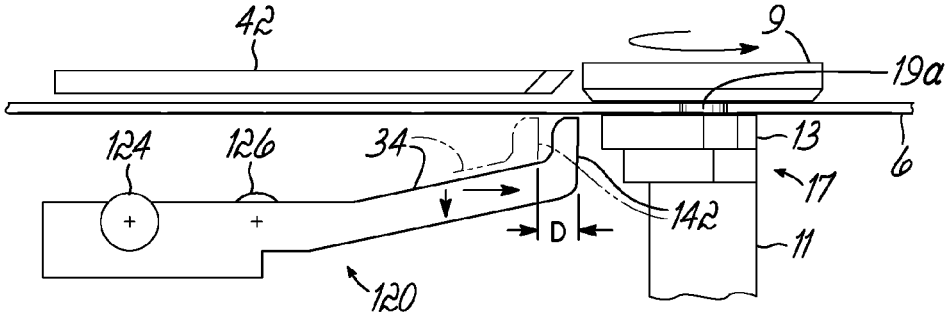

FIGS. 10A and 10AA show the position of the shuttle 15, oscillator 17 and overbend tool 34 in an initial position while an initial portion of wire 6 drawn from a wire source 7 is being formed into a continuous length of sinuous wire 5. The oscillator 17 has a cap 9 and a shaft 11. The letter "D" in FIG. 10A indicates the lateral distance the overbend tool 32 changes due to the adjustment apparatus 32. FIG. 10AA shows the overbend tool 32 in a down position and at its furthest left or withdrawn position. The principal advantage of the present invention is that by rotating the wheel 28 outside housing 30 of the forming apparatus 14 of machine 10, one may adjust the extreme positions of the overbend tool 34, the stroke distance remaining the same but moving laterally to one side or the other. By rotating the wheel 28 of the adjustment apparatus 32 one may change the extreme withdrawn position (to the left in FIG. 10A) of the overbend tool 34 from the position shown in solid lines to the position shown in dashed lines. The letter "D" is shown in FIG. 10AA to show this change in position. By changing the extreme positions of the overbend tool 34, the operator may lengthen or shorten the length of the sinuous spring exiting the punch press (assuming two comparable sinuous springs having the same number of straight parallel bar segments and the same number of connecting segments of the same radius). This change in length is accomplished by changing the angle between the parallel bar segments and the connecting segments.

The vertical distance traveled by the overbend tool 34 during a cycle or stroke does not change regardless of the position of the handle 28 of the adjustment apparatus 32 and regardless of the position of the end 74 of the push rod assembly 68 relative to the crank disc 76. The horizontal distance traveled by the overbend tool 34 during a cycle or stroke does not change regardless of the position of the handle 28 of the adjustment apparatus 32, but does change upon a change in position of the end 74 of the push rod assembly 68 relative to the crank disc 76, i.e. changing the position of fasteners 75 in openings 73. This lateral distance of the stroke may be changed by changing the position of the end 74 of the push rod assembly 68 relative to the crank disc 76. This is accomplished by changing the openings 73 in crank disc 76 into which fasteners 75 engage and hold the end 74 of the push rod assembly 68 and crank disc 76. The horizontal distance traveled by the overbend tool 34 during a cycle or stroke does not change regardless of the position of the handle 28 of the adjustment apparatus 32 but the extreme positions of a stroke or cycle do move left or right as shown in FIGS. 10A, 10AA, 10F and 10FF. In other words, the front stop 142 of the overbend tool 34 may be moved to the left away from the axis of the oscillator, thereby changing the angle between the parallel bar segments and the connecting segments of the resulting sinuous springs.

Figure 10B:
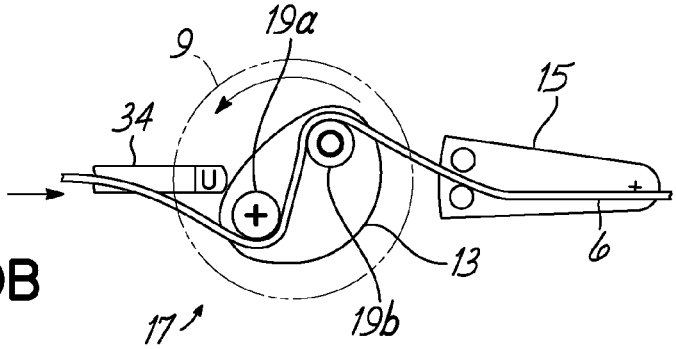
FIG. 10B is a top view of the oscillator moving in a counterclockwise direction while continuing to form a continuous length of sinuous wire.
Figure 10B:
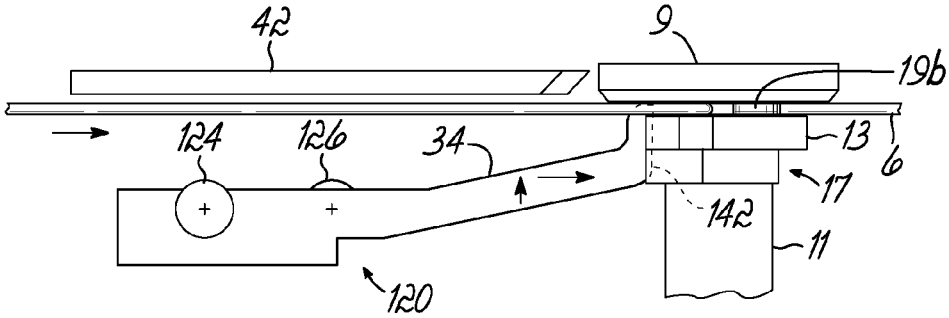

FIGS. 10B and 10BB show the position of the shuttle 15, oscillator 17 and overbend tool 34 in another position. The oscillator 17 has changed positions relative to its position shown in FIG. 10A and 10AA. The letter "U" in FIG. 10B indicates that the overbend tool 34 is in an up position. FIG. 10BB shows the overbend tool 34 at another position to the right of the position shown in FIG. 10AA.

Figure 10C:
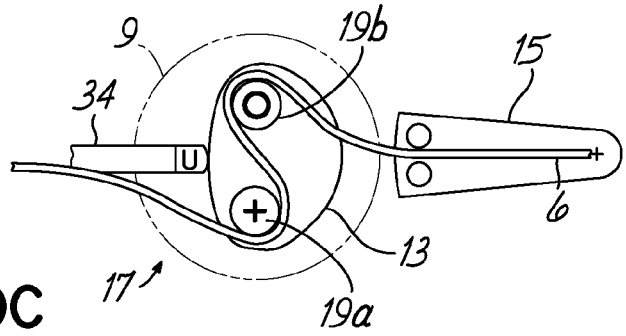
FIG. 10C is a top view of the oscillator in a stopped position.
Figure 10C:
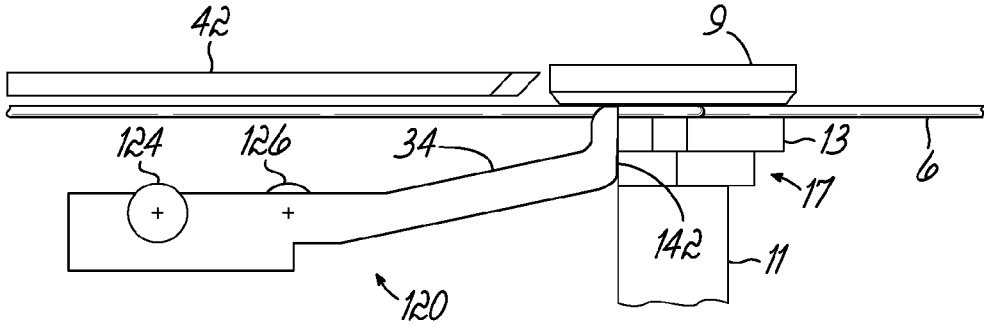
Figure 10D:
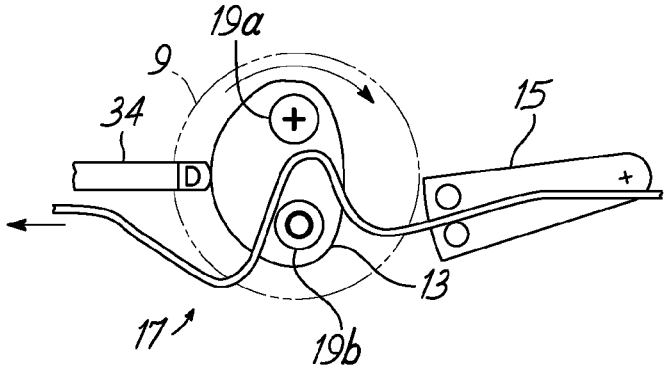
FIG. 10D is a top view of the oscillator moving in a clockwise direction to begin forming a continuous length of sinuous wire.
Figure 10D:
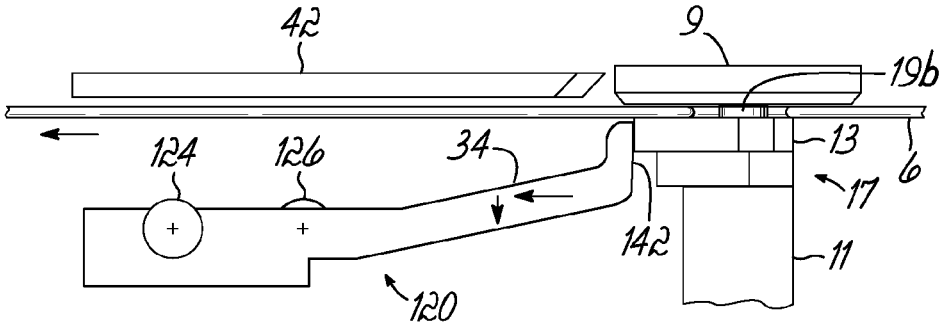
Figure 10E:
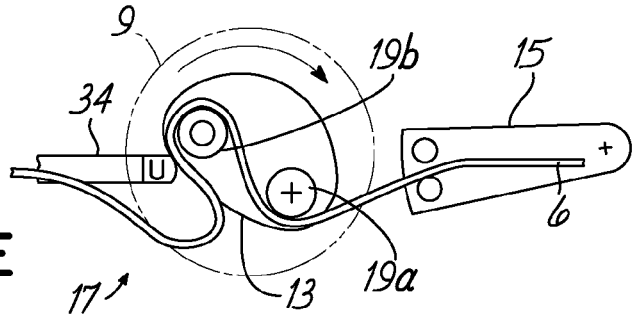
FIG. 10E is a top view of the oscillator moving in a clockwise direction to begin forming a continuous length of sinuous wire.
Figure 10E:
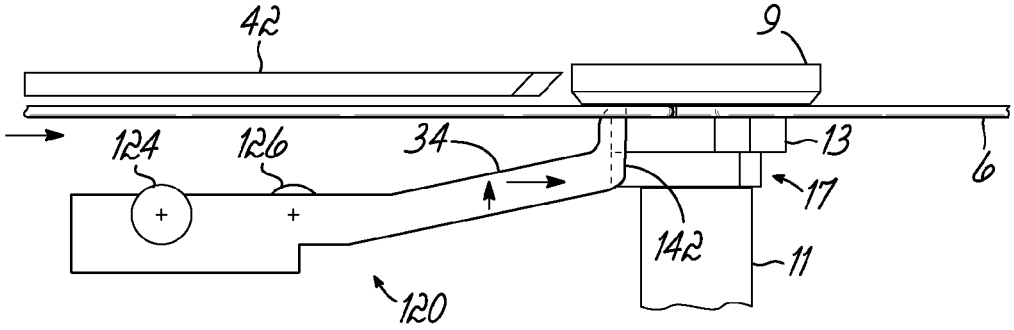
Figure 10F:
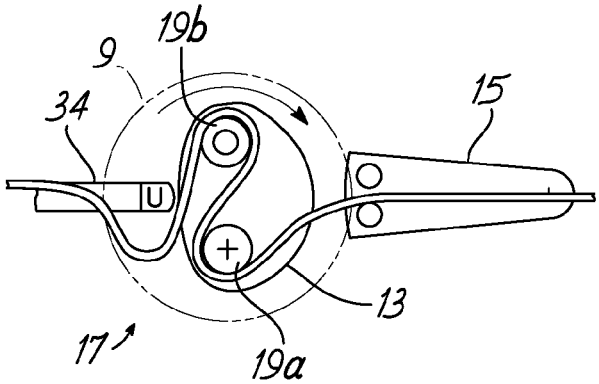
FIG. 10F is a top view of the oscillator moving in a clockwise direction to begin forming a continuous length of sinuous wire.
Figure 10F:
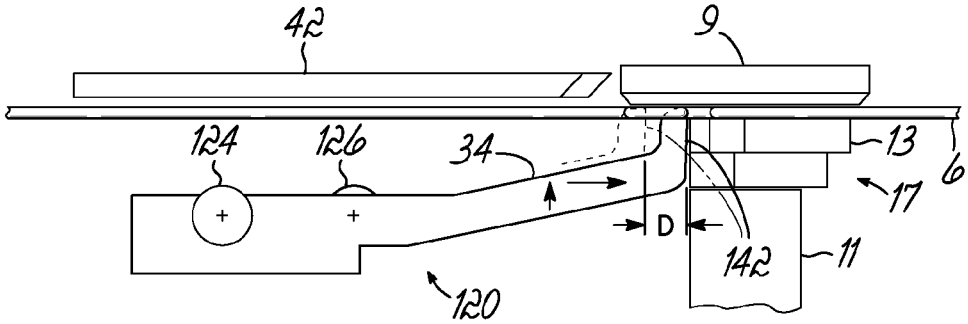

FIGS. 10C, 10CC, 10D, 10DD, 10E, 10EE, 10F and 10FF show other positions of the oscillator 17 and overbend tool 34 during the process of making a continuous length of sinuous spring wire. FIGS. 10F and 10FF, like FIGS. 10A and 10AA, show the principal advantage of the present invention. By rotating the wheel 28 outside housing 30 of the forming apparatus 14 of machine 10, one may adjust the extreme positions of the overbend tool 34. By rotating the wheel 28 of the adjustment apparatus 32 one may change the extreme exposed position (to the right in FIG. 10F) of the overbend tool 34 from the position shown in solid lines to the position shown in dashed lines. The letter "D" is shown in FIG. 10FF to show this change in position. By changing the extreme positions of the overbend tool 34, the operator may lengthen or shorten the length of the sinuous spring exiting the punch press (assuming two comparable sinuous springs having the same number of straight parallel bar segments and the same number of connecting segments of the same radius). This change in length is accomplished by changing the angle between the parallel bar segments and the connecting segments.

While I have described only one preferred embodiment of this invention, persons skilled in this art will appreciate changes and modifications which may be made without departing from the spirit of this invention.

I claim:

1. A machine for manufacturing a plurality of sinuous springs from a supply of wire, the machine comprising:

a forming apparatus for forming a continuous length of sinuous spring wire having parallel bar segments interconnected at their opposite ends by oppositely directed connecting segments, said forming apparatus including a shuttle, an oscillator and an overbend tool adjustable during operation of the machine via an adjustment apparatus;

an accumulator; and a punch press for cutting said continuous length of sinuous wire into sinuous springs of discrete lengths.

2. The machine of claim 1 wherein adjustment apparatus is adjustable via a rotatable handle.

3. The machine of claim 2 wherein the adjustment apparatus comprises:

an adjustment rod having a first end and a second end;

a handle connected to the first end of the adjustment rod for adjusting the length of the adjustment rod;

an end piece connected to the second end of the adjustment rod, said end piece being operatively coupled to an adjustment link at one end of the adjustment link, the opposite end of the adjustment link being operatively coupled to a crank lever which oscillates about an axis defined by a bearing pin, said crank lever being driven by a crank disc via a push rod assembly connected at one end to said crank disc and at the other end to one end of said crank lever, the opposite end of said crank lever being operatively coupled to a slide block which reciprocates in a linear manner, said slide block having a pair of cam blocks and a pair of guide pins attached thereto, said cam blocks having slots therein for guiding an overbend tool assembly, said guide pins being retained in said overbend tool assembly for further guiding said overbend tool assembly.

4. The machine of claim 3 wherein the adjustment apparatus further comprises a cover with a slot therein thorough which a portion of said overbend tool assembly passes to provide a stop for the wire, said wire passing over the cover.

5. The machine of claim 4 wherein the adjustment apparatus further comprises a guide cover and a pair of clamp assemblies for securing the guide cover in place, the wire passing under the guide cover and over the cover.

6. The machine of claim 5 wherein the adjustment apparatus further comprises means to keep the cover lubricated to help the wire move through the forming apparatus to the accumulator.

7. An adjustment apparatus for use on a machine for manufacturing a plurality of sinuous springs from a supply of wire, the adjustment apparatus comprising:

an adjustment rod having a first end and a second end;

a handle connected to the first end of the adjustment rod for adjusting the length of the adjustment rod;

an end piece connected to the second end of the adjustment rod, said end piece being operatively coupled to an adjustment link at one end of the adjustment link, the opposite end of the adjustment link being operatively coupled to a crank lever which oscillates about an axis defined by a bearing pin, said crank lever being driven by a crank disc via a push rod assembly connected at one end to said crank disc and at the other end to one end of said crank lever, the opposite end of said crank lever being operatively coupled to a slide block which reciprocates in a linear manner, said slide block having a pair of cam blocks and a pair of guide pins attached thereto, said cam blocks having slots therein for guiding an overbend tool assembly, said guide pins being retained in said overbend tool assembly for further guiding said overbend tool assembly.

8. The adjustment apparatus of claim 7 wherein the adjustment apparatus further comprises a cover with a slot therein thorough which a portion of said overbend tool assembly passes to provide a stop for the wire, said wire passing over the cover.

9. The adjustment apparatus of claim 7 wherein the adjustment apparatus further comprises a guide cover and a pair of clamp assemblies for securing the guide cover in place, the wire passing under the guide cover and over the cover.

10. The adjustment apparatus of claim 9 wherein the adjustment apparatus further comprises means to keep the cover lubricated to help the wire move through the forming apparatus to the accumulator.

11. A method of manufacturing sinuous springs, each sinuous spring comprising a discrete strip of sinuous spring wire having parallel bar segments interconnected at their opposite ends by oppositely directed connecting segments, which method comprises:

introducing a continuous supply of wire into a machine;

forming a continuous length of sinuous spring wire having parallel bar segments interconnected at their opposite ends by oppositely directed connecting segments, said forming apparatus including a shuttle, an oscillator and an overbend tool adjustable during operation of the machine via an adjustment apparatus to change the position of the parallel bar segments relative to the connecting segments.

12. The method of claim 11 which further comprises passing the continuous length of sinuous spring wire to a punch press for cutting said continuous strip of sinuous wire into strips of discrete lengths.

13. The method of claim 11 which further comprises passing the continuous length of sinuous spring wire to an accumulator prior to passing said continuous strip of sinuous wire into said punch press.

14. A method of manufacturing sinuous springs, each sinuous spring comprising a discrete strip of sinuous spring wire having parallel bar segments interconnected at their opposite ends by oppositely directed connecting segments, which method comprises:

providing a machine for manufacturing sinuous springs of the same length;

adding an adjustment apparatus to the machine so an operator may adjust the length of the sinuous springs by turning a handle.

15. The method of claim 14 wherein the adjustment apparatus changes the position of an overbend tool adjustable during operation of the machine to change the position of the parallel bar segments relative to the connecting segments.

* * * * *